US010068736B2

(12) United States Patent
Pflueger et al.

(10) Patent No.: US 10,068,736 B2
(45) Date of Patent: Sep. 4, 2018

(54) FUSE HOLDER

(71) Applicant: Robert Bosch GmbH, Stuttgart (DE)

(72) Inventors: Claus Gerald Pflueger, Markröningen (DE); Gerhard Schmidt, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 153 days.

(21) Appl. No.: 15/064,840

(22) Filed: Mar. 9, 2016

(65) Prior Publication Data

US 2016/0268092 A1 Sep. 15, 2016

(30) Foreign Application Priority Data

Mar. 10, 2015 (DE) ..... 10 2015 204 295

(51) Int. Cl.

| | |
|---|---|
| ***H01H 85/20*** | (2006.01) |
| ***H01H 85/042*** | (2006.01) |
| *H01H 85/58* | (2006.01) |
| *H01H 85/54* | (2006.01) |
| *H01H 85/22* | (2006.01) |

(52) U.S. Cl.

CPC ..... *H01H 85/2045* (2013.01); *H01H 85/042* (2013.01); *H01H 85/203* (2013.01); *H01H 85/20* (2013.01); *H01H 85/22* (2013.01); *H01H 85/54* (2013.01); *H01H 85/58* (2013.01)

(58) Field of Classification Search

CPC .... H01H 85/042; H01H 85/20; H01H 85/203; H01H 85/2045; H01H 85/22; H01H 85/54; H01H 85/58; H01H 2085/2085

USPC ..... 337/260

See application file for complete search history.

(56) References Cited

U.S. PATENT DOCUMENTS

| | | | | |
|---|---|---|---|---|
| 1,861,267 | A * | 5/1932 | Frank | H01H 85/20 337/188 |
| 4,723,117 | A * | 2/1988 | Griffiths | H01H 85/2045 337/158 |
| 5,700,165 | A * | 12/1997 | Harris | H01H 9/085 439/188 |
| 6,030,257 | A * | 2/2000 | Furuya | H01H 85/2045 439/620.26 |
| 6,101,079 | A * | 8/2000 | Viklund | H01C 7/12 361/104 |
| 6,459,354 | B2 | 10/2002 | Konda et al. | |
| 6,580,040 | B2 | 6/2003 | Konda | |
| 2001/0012731 | A1 | 8/2001 | Sumida et al. | |

(Continued)

FOREIGN PATENT DOCUMENTS

| | | |
|---|---|---|
| DE | 19615561 | 10/1997 |
| DE | 60008347 | 12/2004 |

(Continued)

*Primary Examiner* — Zachary M Pape
*Assistant Examiner* — Jacob Crum
(74) *Attorney, Agent, or Firm* — Michael Best & Friedrich LLP

(57) ABSTRACT

A fuse holder (10) for a high-voltage system for accommodating an electric fuse link (13), comprising a bottom part (11) and a cover (12), which, when assembled, form a housing that serves to accommodate a fuse link (13). The fuse link (13) has two opposite terminal lugs (131), which can be fixed in the cover by means of fastening screws (14), so that, together with the cover (12), the fuse link (13) forms a unit, which is fastened on the bottom part (11) by means of the fastening screws (14).

13 Claims, 4 Drawing Sheets

(56) References Cited

U.S. PATENT DOCUMENTS

| | | | | |
|---|---|---|---|---|
| 2007/0093089 | A1* | 4/2007 | Ford | H01H 9/10 439/76.2 |
| 2008/0184560 | A1* | 8/2008 | Pizzi | H01H 69/02 29/883 |
| 2009/0309689 | A1* | 12/2009 | Pavlovic | H01H 85/153 337/187 |

FOREIGN PATENT DOCUMENTS

| | | | | |
|---|---|---|---|---|
| DE | 10330565 | | 6/2007 | |
| GB | 1209072 | A * | 10/1970 | H01H 85/203 |
| JP | 09102264 | | 4/1997 | |

* cited by examiner

FUSE HOLDER

BACKGROUND OF THE INVENTION

The present invention relates to a fuse holder for a high-voltage system, in particular for a high-voltage battery system of an electric drive, and primarily to a fuse holder for accommodating an electric fuse link, and to a method for inserting or removing a fuse link.

Among the ways in which the automotive industry is reducing the use of fossil fuels is gradual electrification of vehicle drives of hybrid and electric vehicles. In addition, auxiliary and ancillary units in such vehicles are increasingly being electrified, e.g. electric power steering systems. In order to provide the power required in hybrid and electric vehicles, high-voltage battery systems in the form of chargeable or rechargeable energy accumulators are being used. High-voltage battery systems include nickel-metal hydride, lithium-ion and sodium-nickel chloride battery systems, for example. Lithium-ion batteries are being used more and more often since they are distinguished by relatively high energy densities and cell voltages.

For the use of lithium-ion cells in battery systems for the automotive sector, a multiplicity of cells are generally interconnected in series, in parallel or in parallel and in series to form modules, and a number of modules are combined to form battery blocks. In electric vehicles, such battery systems in some cases have voltages of over 450 V, and, even in the case of hybrid vehicles, the voltage of 60 V assumed as the safety threshold for contact with humans is exceeded. When such battery systems are used as primary sources of energy, a relatively high current can furthermore occur. To separate a high-voltage battery system from a consuming system, e.g. an electric drive of a vehicle, on one side or on both sides, high-voltage battery systems can be provided with isolating devices, which have high-voltage fuses, high-voltage contactors and service disconnectors, for example. In normal operation and during servicing/maintenance but also in accidents or when there is a fault in the system, galvanic isolation and contact protection from dangerous potentials are possible with the aid of these isolating devices (operator protection).

The high voltages and currents which occur in high-voltage battery systems are typically protected by a fuse in the circuit to avoid damage in the event of a fault. If there is a fault, there may be voltage across the contacts of the fuse when installing the fuse or when repair work is necessary, owing to the battery forming the primary energy source. Due to carelessness or incorrect working methods, short circuits may occur, and these can cause damage to battery cells, electronic components, electrical components and mechanical components. There is furthermore the risk that a technician may accidentally touch live components during a repair and may be put at risk by an electric shock.

Fuses or fuse links are generally accommodated by a fuse holder and inserted between a voltage source, e.g. a high-voltage battery, and an electric drive. Fuse boxes or cases are known from the publications DE 103 30 565 B4, DE 196 15 561 C2 and DE 600 08 347 T2, for example, and typically have a top and a bottom housing part, wherein the top housing part can be designed as a cover. The fuse links are arranged and secured in a receiving region, into which also a busbar can project. The fuse boxes or cases can generally be secured on the battery. While the fuse boxes or cases known from the prior art are intended to protect one or more fuse links from external influences (mechanical influences, heat), make it easier to exchange fuse links and reduce fixing and fastening errors, unintentional contact between the fuse link and the battery casing when exchanging the fuse link, and hence a short circuit, cannot be completely excluded.

Given this background situation, it is an object of the present invention to make available a holding device for accommodating a fuse link which allows reliable and simple insertion or removal of the fuse link, thus making it possible to exclude a short circuit with a tool or between the fuse link to be inserted or removed and the housing of a battery system and hence also the risk of injury to people from an electric shock.

SUMMARY OF THE INVENTION

To achieve the object, a fuse holder for a high-voltage system and a method for inserting or removing a fuse link in and from a fuse holder of a high-voltage system are proposed.

Accordingly, the invention provides a fuse holder for a high-voltage system for accommodating an electric fuse link, said holder comprising a bottom part and a cover, which, when assembled, form a housing that serves to accommodate a fuse link. The fuse link has two opposite terminal lugs, which are fixed in the cover by means of fastening screws, so that, together with the cover, the fuse link forms a unit, which is fastened on the bottom part by means of the fastening screws. This enables the fuse link together with the cover and the screws to be removed as a unit from the fuse holder, enhancing the protection of the fuse link against accidental contact and simplifying the exchange of the fuse link. It is advantageous if the fuse link is furthermore fixed in the cover by means of latching projections. It is thus possible to achieve a fuse link which is protected against accidental contact.

As compared with the prior art, the fuse holder according to the invention has the advantage that reliable and simple insertion or removal of the fuse link is made possible, even in the case of repair. At the same time, it is ensured, according to one embodiment, that no short-circuiting with a tool or between the fuse link to be removed and the battery housing is possible. The risk of injury from an electric shock to someone inserting or removing the fuse link can therefore be eliminated when using the fuse holder according to the invention. According to one possible embodiment, it is possible to measure electrical variables, e.g. the transfer resistance between a busbar and the fuse, without removing the protective insulation of the fuse holder. To make the fuse easier to install, the busbars of the battery cells are guided for securing in the fuse holder. Fuse holders according to the prior art do not offer simple insertion or removal while simultaneously excluding a short circuit. The possibility of measuring the transfer resistance across a fuse link protected from accidental contact, as is possible when using the fuse holder according to the invention, is completely unknown from the prior art.

One of the advantages of the fuse holder according to the invention is that no additional or auxiliary parts are required and therefore the number of components or component parts is limited, allowing low-cost production in large numbers.

Another advantage of the fuse holder according to the invention is that sufficient protection against accidental contact can be ensured in any installation situation. In the case of repair, the fuse link including the fastening screws, washers and cover are exchanged. It is thereby possible to ensure that no component parts are forgotten and that fault-free component parts are always used.

In an advantageous embodiment of the invention, it is envisaged that more than one fuse link is accommodated in the housing formed by the bottom part and the cover.

In another advantageous embodiment of the invention, it is envisaged that each of the fastening screws has a screw head and is fastened on the bottom part in combination with a washer that can be positioned under the screw head, wherein the washer is suitable for preventing introduction of a friction torque occurring under the screw head into the terminal lug. This makes it possible to prevent the fuse link from being displaced.

According to a preferred embodiment of the invention, it is envisaged that the cover has guides, which secure the screw heads against twisting and falling out. Integrating guides into the cover avoids the use of additional elements.

According to another preferred embodiment of the invention, it is envisaged that the bottom part has threaded parts, which are dimensioned to receive the fastening screws for screw fastening. The threaded parts can furthermore be designed in such a way that they accept the torques associated with installation forces occurring during screw fastening.

Provision is preferably furthermore made for the threaded parts to be pressed into the bottom part.

Another advantageous embodiment of the invention envisages that the bottom part furthermore has latching projections, which are arranged on the same axis as the threaded parts and by means of which the cover is fixed on the bottom part. This has the advantage that the fuse link can be unlatched from the cover together with the fastening screws and the cover can be latched onto the bottom part of the fuse holder in order to ensure insulation of busbars when the fuse link has been removed.

Another advantageous embodiment of the invention envisages that the cover has access holes, in which a tool can be guided in insulated fashion. This allows electrical testing of the fuse link and/or of the electrical connection between the busbar and the fuse link. In this process, the measuring tips are guided in the access holes in the cover and are insulated during measurement. It is advantageous if the access holes are embodied in such a way that finger contact protection is furthermore ensured.

Another advantageous embodiment of the invention envisages that the cover furthermore has gripping strips, which are used for handling the cover. Safer handling of the cover and thus of the fuse link is thereby made possible.

To achieve the object stated at the outset, a method for inserting and removing a fuse link in a fuse holder of a high-voltage system is furthermore proposed. The method is essentially characterized by the following steps: fixing the fuse link in a cover of the fuse holder; mounting and fastening the cover, including the fuse link, on a bottom part of the fuse holder; releasing and removing the cover, including the fuse link, from the bottom part; and exchanging the cover, including the fuse link.

BRIEF DESCRIPTION OF THE DRAWINGS

Further advantageous details, features and particulars of the embodiment of the invention are explained in greater detail in conjunction with the illustrative embodiments shown in the figures, of which.

Component parts which are identical or functionally identical are provided with the same reference signs in the figures.

DETAILED DESCRIPTION

High-voltage systems in the sense according to the present invention are systems or installations which have components or component parts that operate with high electrical voltages or currents or to which correspondingly high electrical voltages are applied, at least temporarily, or on which correspondingly high currents can flow. In this context, high voltages can be voltages which are potentially harmful to human health, e.g. voltages of more than 60 volts. High-voltage systems can be used particularly in electric drive systems of electrically operated vehicles, e.g. in hybrid vehicles, electric cars, fuel cell vehicles or vehicles with an extended range. These high-voltage systems may be subject to human access, e.g. during servicing, inspection or repair of the electrically operated vehicle.

Figure 1:
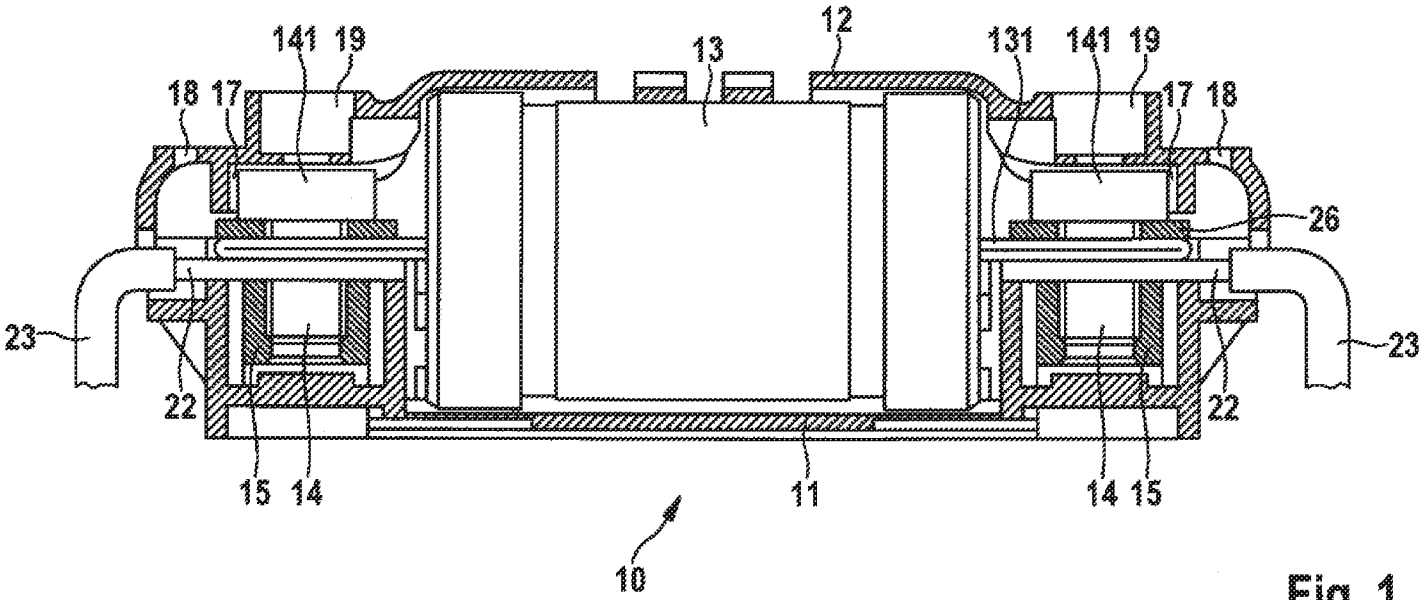
FIG. 1 shows the schematic structure of the fuse holder according to the invention in a cross section.
Figure 2:
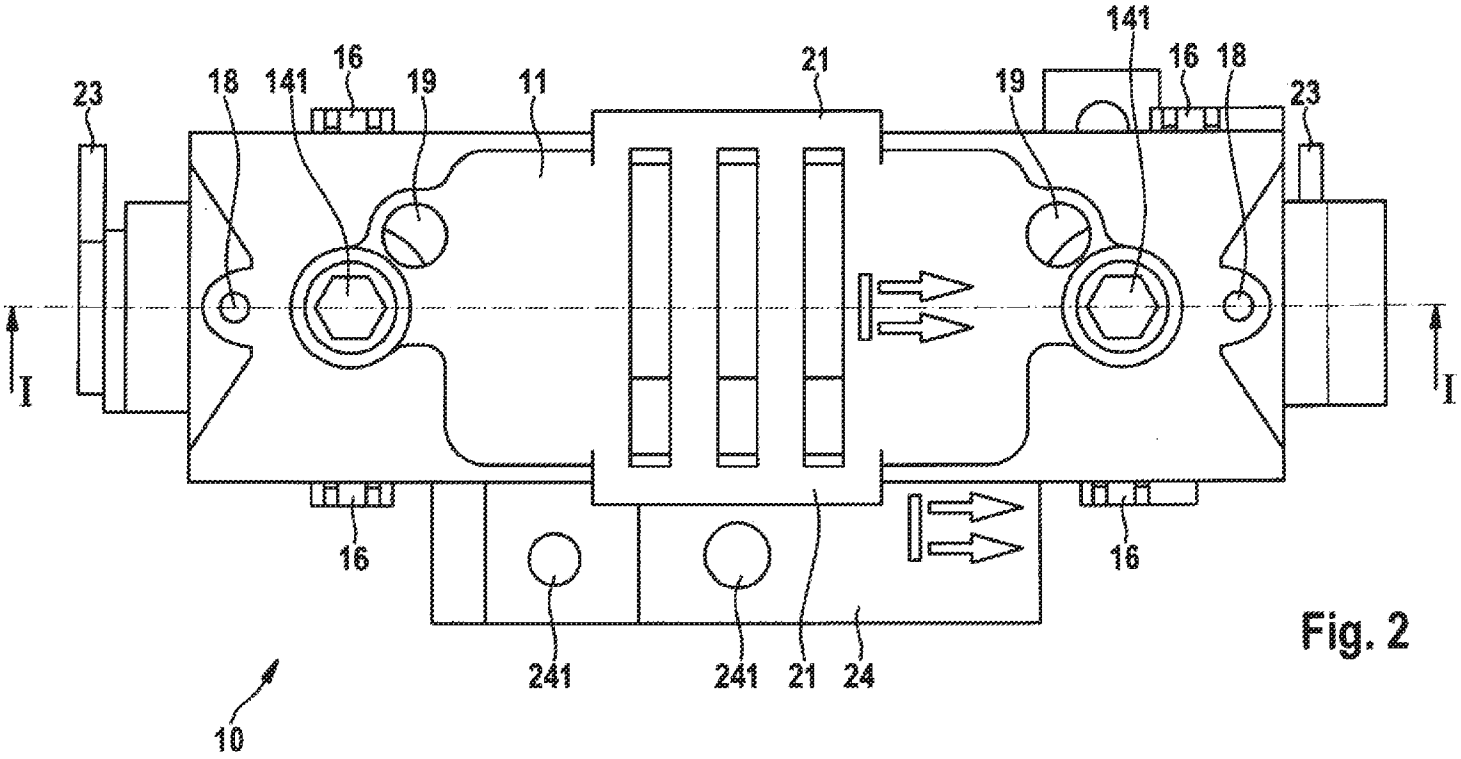
FIG. 2 shows a plan view of a fuse holder according to the invention.
Figure 3:
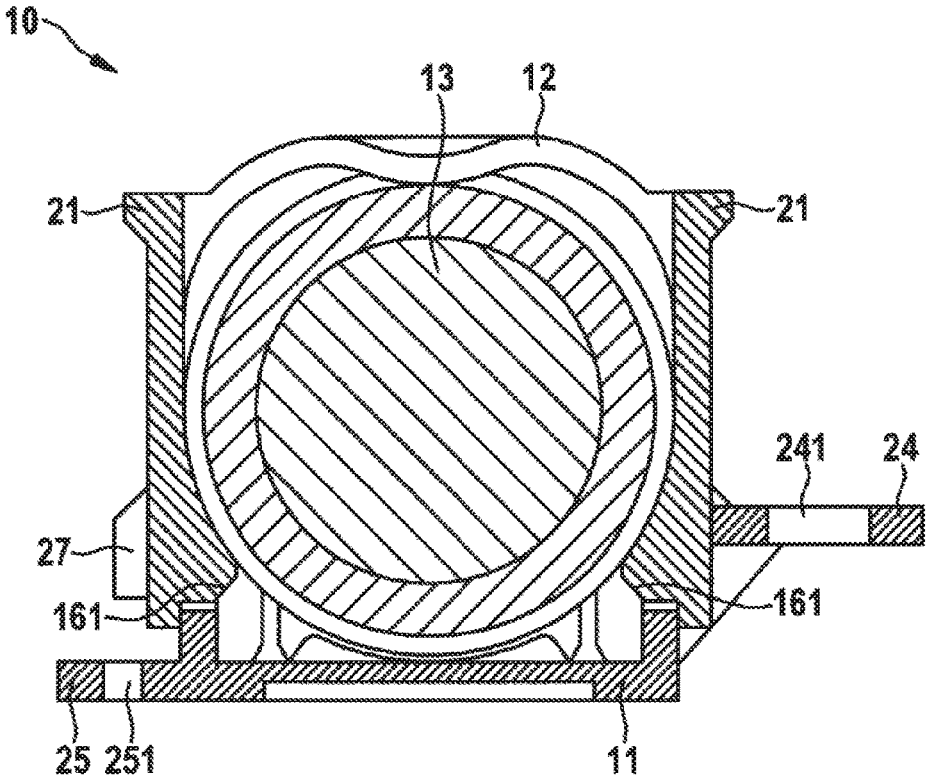
FIG. 3 shows the fuse cover fixed in the fuse link in a schematic illustration.
Figure 4:
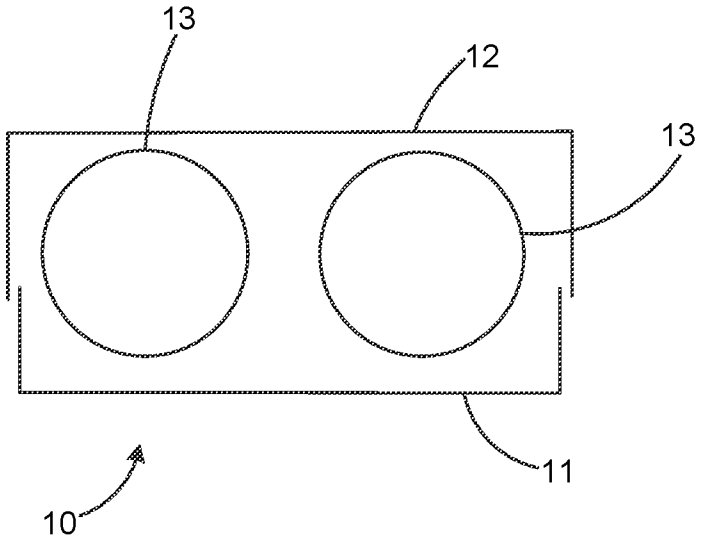
FIG. 4 is a schematic view of an alternative embodiment with two fuse links.

The schematic structure of a fuse holder 10 according to the invention is shown in FIG. 1 and FIG. 2. The fuse holder 10 can preferably be used in a high-voltage system. The fuse holder 10 has a bottom part 11 and a cover 12, which, when assembled, form a housing that serves to accommodate an electric fuse link 13. Alternatively, the bottom part 11 and the cover 12 can be configured in such a way that several fuse links can be accommodated. According to one embodiment, the fuse link 13 is fixed in the cover 12 by means of fastening screws 14 and can thus be screwed directly to the bottom part 11 together with the cover 12. The fuse link 13 can furthermore preferably be fixed in the cover 12 by means of latching projections 161 (FIG. 3). The fuse link 13 preferably has two opposite terminal lugs 131, which are used to fasten the fuse link 13 in the cover 12. The terminal lugs 131 are preferably designed in such a way that they can be gripped by the fastening screws 14 during assembly. As a result, the fuse link 13 together with the cover 12 forms a unit that can be fastened on the bottom part 11 by means of the fastening screws 14. The fastening screws 14 preferably have screw heads 141. The fastening screws 14 can be installed in combination with washers 26, which are positioned underneath the respective screw head 141. The washers 26 are preferably designed in such a way that the friction torque under the screw head 141 is not introduced into terminal lugs 131 of the fuse link 13. It is thereby possible to prevent the fuse link from being displaced. Threaded parts 15 for screw-fastening the fuse link 13 can be provided in the bottom part 11. The threaded parts 15 are preferably dimensioned to receive the fastening screws 14 for screw fastening. The threaded parts 15 can be pressed into the bottom part 11, for example. The threaded parts 15 can furthermore be designed in such a way that they accept the torques associated with installation forces occurring during screw fastening. The fuse link 13 and fastening screws 14 are secured against twisting and falling out by guides 17 for the screw heads 141 in the cover 12.

The screw fastening of the fuse link 13 is preferably carried out at two opposite positions. According to one embodiment, two opposite threaded parts 15 and fastening screws 14 are thus used in each case. The use of different fastening elements instead of the fastening screws 14 may be possible. According to one embodiment, the bottom part 11 can furthermore have latching projections 16, using which the cover 12 can be fixed on the bottom part 11 by means of a cover latch 27 (FIG. 3). The latching projections 16 are preferably arranged on the same axis as the threaded parts 15 and thus the screw fastening.

The insulation of a tool relative to the housing of the fuse holder 10 is ensured by access holes 18 and 19 in the cover 12, which can guide a tool. Access hole 19 is preferably furthermore embodied in such a way that finger contact protection is ensured.

In FIG. 3, the fuse link 13 is shown fixed in the fuse cover 12. The fuse holder 10 can furthermore have devices 24 and 25 for mounting on a housing of a high-voltage source, e.g. a high-voltage battery system. The mounting devices 24 and 25 can each be designed as a flange that has holes 241 and 251 for fastening elements, for example. By installing the fuse holder 10 directly on the housing of the high-voltage source, it is possible to save installation space, e.g. within a vehicle, and to save on additional connecting cables.

In fitting and removing the cover 12, the fuse link 13 is fixed in the cover 11 by means of the fastening screws 14 and the latching projections 161 and can be screwed directly to the bottom part 11. For fitting, the cover 12 is placed on the bottom part 11 and the fastening screws 14 are screwed into the threaded parts 15. The cover 12 is then latched into the latching projections 16 from above by slight pressure. For removal, the fastening screws 14 are loosened. The cover 12 is thereby automatically pushed upward, with the result that the cover 12 unlatches from the latching projections 16. Once the fastening screws 14 have been loosened completely, the cover 12 can then be removed completely, together with the fuse link 13 and the fastening screws 14, from the bottom part 11. According to one embodiment, this is assisted by two gripping strips 21 (as shown in FIG. 2). The gripping strips 21 are preferably arranged in the top part and on opposite sides of the cover 12.

One advantage of the fuse holder 10 according to the invention is that it does not require any additional or auxiliary parts. Moreover, sufficient protection against accidental contact is ensured in any installation situation. In the case of repair, the fuse link including the fastening screws 14, washers 26 and cover 12 are exchanged. It is thereby possible to ensure that no component parts are forgotten and that fault-free component parts are always used.

In order to ensure insulation of busbars 22 when the fuse link 13 has been removed, the fuse link 13 can be unlatched from the cover 12 together with the fastening screws 14, and the cover 12 can be latched onto the bottom part 11 of the fuse holder 10. An input-side and an output-side busbar 22 are preferably arranged on opposite sides of the fuse holder 10 and can each be connected to a power supply line 23. Alternatively, the input-side busbar 22 can be connected directly to a battery terminal, thereby making it possible to eliminate a supply wire. By means of the power supply line 23, the fuse holder 10 can be connected between a voltage source and an electric drive. Alternatively, the input-side busbar 22 can be connected directly to a battery terminal, thereby making it possible to eliminate an input-side supply wire 23. The voltage source can be a rechargeable high-voltage battery system, for example, and, in particular, a lithium-ion battery system. The electric drive can be provided for a hybrid or electric vehicle, for example.

According to one possible embodiment, the electrical testing of the fuse link 13 and/or of the electrical connection between the busbar 22 and the fuse link 13 can be performed via two access holes 18 and 19 arranged in pairs in the cover 12 (as shown in FIG. 2). Here, the measuring tips can be guided in the access holes 18 and 19 in the cover 12 and are thus insulated from the housing of the fuse holder 10.

Thus, the fuse holder 10 according to the invention includes the functions described below. Because the fuse link 13 is secured in the cover 12 of the fuse holder 10, reliable and simple insertion or removal of the fuse link is made possible, even in the case of repair. At the same time, it is possible to ensure that short-circuiting of the fuse link 13 to be removed to a housing of a battery system is not possible. Through the integration of access holes 18 and 19, it is furthermore ensured that there can be no short circuit with a tool. The risk of injury from an electric shock to a person inserting or removing the fuse link 13 can thus be eliminated. It is possible to measure electrical variables, e.g. the transfer resistance between the busbar 22 and the fuse link 13, via the access holes 18 and 19 and thus without removing the protective insulation of the fuse holder 10. For simpler installation of the fuse holder 10, the busbars 22 of the battery cells can be fed to the fuse link 13 in the fuse holder 10.

The illustrative embodiments shown in the figures and explained in conjunction with these serve to explain the invention and are not restrictive of the latter.

What is claimed is:

1. A fuse holder (10) for a high-voltage system comprising:

a bottom part (11); and a unit including a cover (12), an electric fuse link (13) having opposite first and second terminal lugs (131), and first and second fastening screws (14) having respective heads and threaded portions, wherein the cover (12) and the fuse link (13) are latched together such that the head (141) of the first fastening screw (14) is captured between the first terminal lug (131) and the cover (12) and the head (141) of the second fastening screw (14) is captured between the second terminal lug (131) and the cover (12), such that each of the screw heads (141) is accessible through the cover (12), such that each of the fastening screws (14) is rotatable with respect to the cover (12), such that the threaded portions at least partially project beneath the cover, and such that the unit is configured to be fastened on the bottom part (11) by threading the threaded portions into the bottom part, and wherein, when the bottom part (11) is fastened to the cover (12), the bottom part (11) and the cover (12) form a housing that accommodates the fuse link (13).

2. The fuse holder (10) according to claim 1, wherein more than one fuse link (13) is accommodated in the housing formed by the bottom part (11) and the cover (12).

3. The fuse holder (10) according to claim 1, wherein each of the fastening screws (14) is fastened on the bottom part (11) in combination with a washer (26) positioned under a corresponding screw head (14), wherein the washer (26) is suitable for preventing introduction of a friction torque occurring under the screw head (141) into the terminal lug (131).

4. The fuse holder (10) according to claim 3, wherein the cover (12) has guides (17), which secure the screw heads (141).

5. The fuse holder (10) according to claim 1, wherein the bottom part (11) has threaded parts (15), which are dimensioned to receive the threaded portions of the fastening screws (14) for screw fastening.

6. The fuse holder (10) according to claim 5, wherein the threaded parts (15) are pressed into the bottom part (11).

7. The fuse holder (10) according to claim 5, wherein the bottom part (11) furthermore has latching projections (16), which are arranged on the same axis as the threaded parts (15) and by which the cover (12) is fixed on the bottom part (11).

8. The fuse holder (10) according to claim 1, wherein the cover (12) has access holes (18, 19), in which a tool can be guided in insulated fashion.

9. The fuse holder (10) according to claim 1, wherein the cover (12) furthermore has gripping strips (21), which are used for handling the cover (12).

10. A method for inserting and removing a fuse link (13) in and from a fuse holder (10) of a high-voltage system according to claim 1, characterized by the following steps:

fixing the fuse link (13) in the cover (12) of the fuse holder (10);

mounting and fastening the cover (12), including the fuse link (13), on the bottom part (11) of the fuse holder (10);

releasing and removing the cover (12), including the fuse link (13), from the bottom part (11); and exchanging the cover (12), including the fuse link (13).

11. The fuse holder (10) according to claim 1, wherein the cover (12) and the fuse link (13) are latched together by latching projections (161) of the cover (12) that fit around the fuse link (13).

12. The fuse holder (10) according to claim 1, wherein a washer (26) is positioned between each of the screw heads (141) and a corresponding terminal lug (131).

13. The fuse holder (10) according to claim 1, wherein the cover (12) includes first and second access holes that provide access to heads (141) of the first and second fastening screws, respectively, such that a tool may be inserted through each of the of access holes to rotate a corresponding fastening screw (14).

* * * * *